US007541921B2

(12) United States Patent
Wittorf et al.

(10) Patent No.: US 7,541,921 B2
(45) Date of Patent: Jun. 2, 2009

(54) METHOD AND SYSTEM FOR EMERGENCY CALLS FROM VEHICLES

(75) Inventors: Marten Wittorf, Ingelheim (DE); Lars Hoffmann, Brålanda (SE); Matthias Hofmann, Stuttgart (DE)

(73) Assignee: GM Global Technology Operations, Inc., Detroit, MI (US)

( * ) Notice: Subject to any disclaimer, the term of this patent is extended or adjusted under 35 U.S.C. 154(b) by 228 days.

(21) Appl. No.: 11/484,572

(22) Filed: Jul. 12, 2006

(65) Prior Publication Data

US 2008/0074245 A1 Mar. 27, 2008

(30) Foreign Application Priority Data

Jul. 14, 2005 (SE) ..... 0501666

(51) Int. Cl.
*G08B 1/08* (2006.01)

(52) U.S. Cl. ..... 340/539.11; 340/506; 340/425.5; 340/426.1; 340/426.18; 340/539.13; 340/539.1

(58) Field of Classification Search ..... 340/539.11, 340/506, 425.5, 426.1, 426.18, 539.13, 539.1
See application file for complete search history.

(56) References Cited

U.S. PATENT DOCUMENTS 5,513,244 A * 4/1996 Joao et al. ..... 455/404.1
5,612,878 A * 3/1997 Joao et al. ..... 455/456.1
5,917,405 A * 6/1999 Joao ..... 340/426.17
6,542,076 B1 * 4/2003 Joao ..... 340/539.14

* cited by examiner

*Primary Examiner*—Daryl Pope
(74) *Attorney, Agent, or Firm*—Harness, Dickey & Pierce, P.L.C.

(57) ABSTRACT

A method for an emergency call from a vehicle to an alarm centre, including receiving a wireless initiation signal from a portable alarm unit, evaluating the initiation signal, and sending, based on the result of the evaluation, a wireless alarm signal from a vehicle communication system arranged in the vehicle to the alarm centre. If the owner of the vehicle or some other person gets into an emergency, for instance is assaulted, in the immediate surroundings of the vehicle, it is thus possible to send an alarm signal to an alarm centre via the vehicle without first entering it. The personal safety for the individual is therefore increased. In addition, in the case of an assault, the perpetrator can be frightened away by sound and/or light signals emitted by the vehicle.

10 Claims, 4 Drawing Sheets

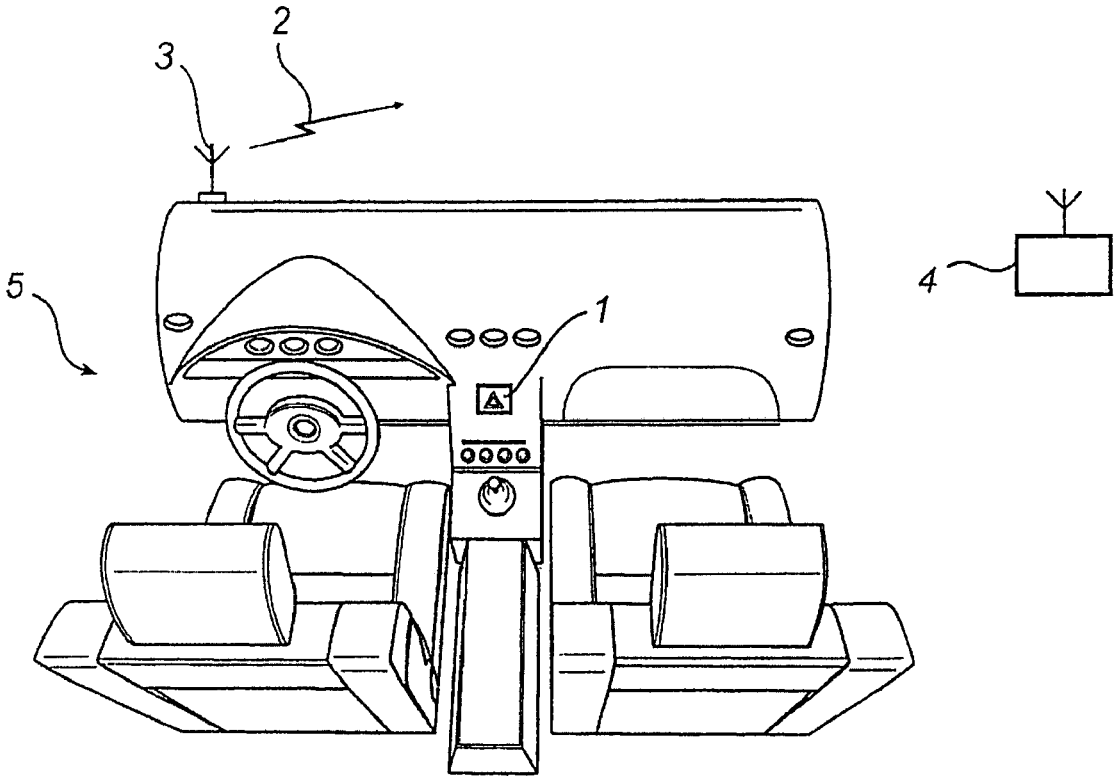
(Prior Art) Fig. 1
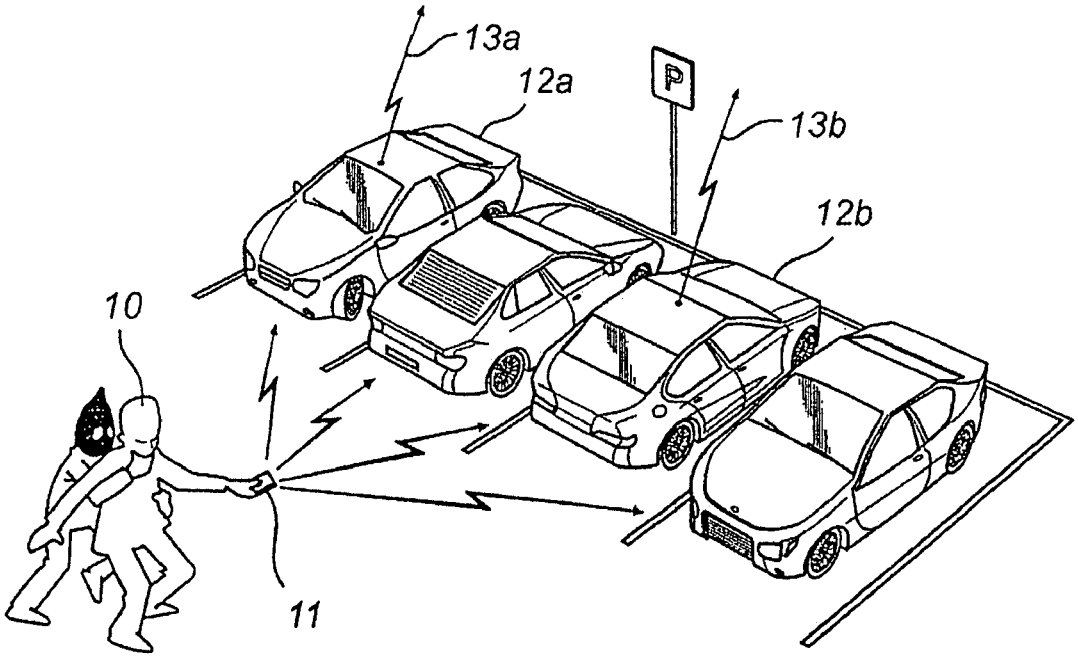
Fig. 2

METHOD AND SYSTEM FOR EMERGENCY CALLS FROM VEHICLES

PRIORITY STATEMENT

This application claims benefit of priority under 35 U.S.C. § 119 from Swedish Patent Application No. 0501666-2 filed on Jul. 14, 2005, in the Swedish Patent Office, the disclosure of which is incorporated herein by reference in its entirety.

FIELD

Example embodiments relate to a method for an emergency call from a vehicle to an alarm centre.

Example embodiments also concern an emergency call system for vehicles.

BACKGROUND ART

Nowadays cars are frequently equipped with alarm systems for deterring thieves and vandals. There are also systems that can be used to alarm, for instance using the horn of the car, in the case of an emergency. Furthermore systems are known which can alarm by contacting an alarm centre via mobile communication.

U.S. Pat. No. 6,310,543 discloses such a system where an alarm system can be activated by a person in the car pressing an emergency call button. With the emergency call button depressed, an emergency call is sent by way of an integrated mobile phone to an alarm centre. The emergency call may include information about the position and travelling direction of the car.

The article "Airbags bei Citroen senden Notruf" in Netzeitung.de of 2 May 2005 describes a similar system for sending an emergency call. This system, which is integrated in a system for navigation, hi-fi and mobile telephony, makes it possible to send an emergency call to an alarm system either automatically in the case of an accident, or by a user pressing a button in the system.

A drawback of these systems is that the availability of the emergency call system is relatively limited. This means that the personal safety for the individual may suffer since the emergency call system cannot be activated in all emergencies.

SUMMARY

Example embodiments increase the availability of an emergency call system.

Example embodiments provide improved personal safety for the individual.

Example embodiments include a method and an emergency call system according to claims 1 and 8.

At least one example embodiment concerns a method for an emergency call from a vehicle to an alarm centre, comprising receiving a wireless initiation signal from a portable alarm unit, evaluating the initiation signal, and sending, based on the result of the evaluation, a wireless alarm signal from a vehicle communication system arranged in the vehicle to the alarm centre.

The portable alarm unit can be a special alarm unit, or the alarm function can be, for instance, integrated in the remote-control unlocking unit of the vehicle (key, remote control, key card etc).

Based on the result of the evaluation of the initiation signal, the vehicle can also emit sound and/or light signals, for instance by way of the horn and/or the headlamps and/or the interior lighting.

By this method an initiation signal is thus wirelessly received from a portable alarm unit. This means that a stationary alarm button, positioned for instance on the dashboard, need not be activated for an alarm signal to be sent to the alarm centre.

If the owner of the vehicle or some other person gets into an emergency, for instance is assaulted, in the immediate surroundings of the vehicle, it is thus possible to send an alarm signal to an alarm centre via the vehicle without first entering it. The personal safety for the individual is therefore increased. In addition, in the case of an assault, the perpetrator can be frightened away by sound and/or light signals emitted by the vehicle.

Moreover, in the case of an accident, it may be difficult for the individuals in the vehicle to reach a stationary button, and therefore wireless initiation using a portable alarm unit results in increased availability of the emergency call system and, thus, increased personal safety for the individuals.

The wireless initiation signal may comprise an identification code which identifies the alarm unit.

By sending together with the initiation signal an identification code, the risk of false alarms can be reduced since the identity of the person who initiates the alarm can be sent on to the alarm centre.

In at least one example embodiment, evaluating the initiation signal comprises identifying said initiation signal as an emergency signal, and allowing emission of a wireless alarm signal in response to a wireless initiation signal from each of a plurality of portable alarm units, the alarm units having different identities.

In at least one example embodiment, an alarm signal can thus be emitted in response to an initiation signal received from each of a plurality of different alarm units. Thus a person who has no relation to a specific vehicle can by way of his portable alarm unit still activate the emergency call system of the vehicle. Of course, also sound and light signals can be emitted from the vehicle.

The technical effect achieved by the present embodiment thus is that each of a plurality of wireless alarm units with different identities, when sending an emergency signal, will access the emergency call system of the vehicle.

An objective problem resulting from said technical effect will thus be: How should a user without relation to a vehicle be allowed to access the emergency call system of the vehicle?

To solve this problem, a person skilled in the art would probably find no clues from the literature about the conventional unlocking remote control of a car. The reason for this is that the work for developing such remote controls has, for obvious reasons, focused on decreasing as much as possible the possibility for users to access a vehicle without precisely the remote control that belongs to the specific vehicle.

Emission of a wireless alarm signal may also be allowed in response to a wireless initiation signal from a portable alarm unit which is related to another vehicle.

Methods according to example embodiments may further comprise obtaining a safety-related signal from a sensor located in the vehicle.

By "safety-related signal" is meant a signal whose value can provide information about an emergency.

Such a signal may be, for instance, one of belt stretching signal, acceleration sensor signal, temperature signal, airbag signal, tyre pressure signal and engine status signal. It goes without saying that also other signals are conceivable.

The provision of this type of signals allows information about the kind of emergency to be sent to the alarm centre. The activities following the alarm can thus be better adjusted to the current situation.

Evaluating the initiation signal may also comprise evaluating the safety-related signal provided.

By evaluating the provided safety-related signal, information about the emergency can in many cases be obtained. Such information can be very useful for the alarm centre.

The alarm signal sent to the alarm centre may comprise information about at least one of the position of the vehicle, the identity of the vehicle, the identity of the alarm unit and information about the emergency.

In this way, the staff of the alarm centre can be given better possibilities of quickly sending the correct assistance to the correct location. This increases the probability of the emergency achieving a successful outcome.

At least one example embodiment concerns an emergency call system for vehicles, comprising a receiver located in a vehicle and adapted to receive a wireless initiation signal from a portable alarm unit, a control unit connected to the receiver and adapted to send, after evaluation of said initiation signal, an alarm command to a vehicle communication system, the vehicle communication system being adapted to send, in response to said alarm command, a wireless alarm signal to an alarm centre.

BRIEF DESCRIPTION OF THE DRAWINGS

Example embodiments will now be described in more detail with reference to the accompanying drawings.

FIG. 1 illustrates an emergency call system of prior-art type.

FIG. 2 illustrates schematically a possible use of the emergency call system according to an example embodiment.

DETAILED DESCRIPTION EXAMPLE EMBODIMENTS

Figure 3:
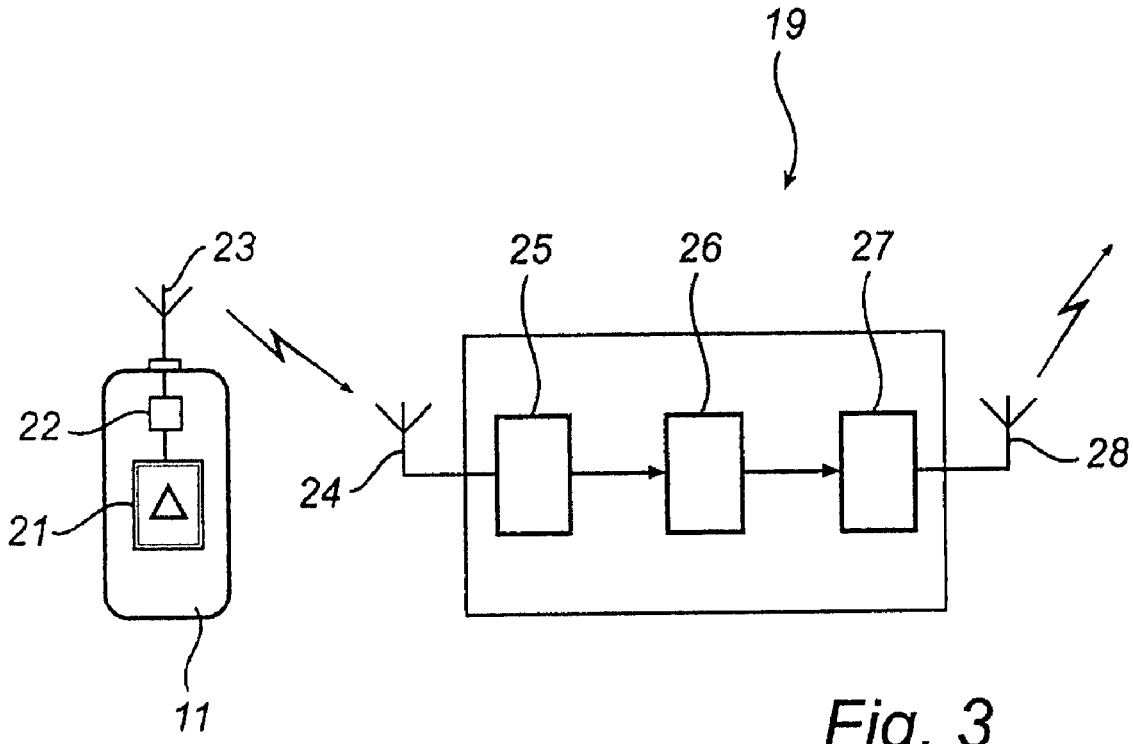
FIG. 3 illustrates schematically a first embodiment of an emergency call system according to an example embodiment.

The following description concerns an emergency call system in a passenger car. However, example embodiments may advantageously be used also in other vehicles, such as busses, coaches, motorcycles, lorries, trucks etc.

FIG. 1 illustrates a prior-art emergency call system with an alarm button 1 which is fixedly arranged in a car 5. When the driver or a passenger presses the button 1, an alarm signal 2 is generated, which via an antenna 3 on the car 5 is sent to an alarm centre 4.

Such a prior-art emergency call system is not accessible in a situation as illustrated in FIG. 2. FIG. 2 which illustrates a possible use of the emergency call system according to the present invention, shows how an assaulted person 10 can activate, by way of his alarm unit 11, for instance in the form of a key with a remote-control unlocking function, the emergency call system in two cars 12*a-b* parked nearby. From these cars, signals 13*a-b* are immediately sent to an alarm centre. The assaulted person 10 can thus by way of an emergency call system according to example embodiments quickly and at a distance access the emergency call systems in cars 12*a-b* parked nearby. The inventive emergency call system integrated in the cars 12*a-b* thus results in increased personal safety for individuals who have the emergency call system in their own vehicles and their alarm unit 11 available.

FIG. 3 illustrates schematically an example embodiment of an emergency call system 19 according to an example embodiment, comprising an alarm unit 11 with an alarm button 21, a radio transmitter 22 and an antenna 23, for example, integrated. An antenna 24 positioned in the car is connected to a receiver 25 which in turn is connected to a control unit 26 which is connected to the vehicle communication system 27 of the car. The vehicle communication system 27 can, via an antenna 28, communicate with an alarm centre (not shown).

Figure 4:
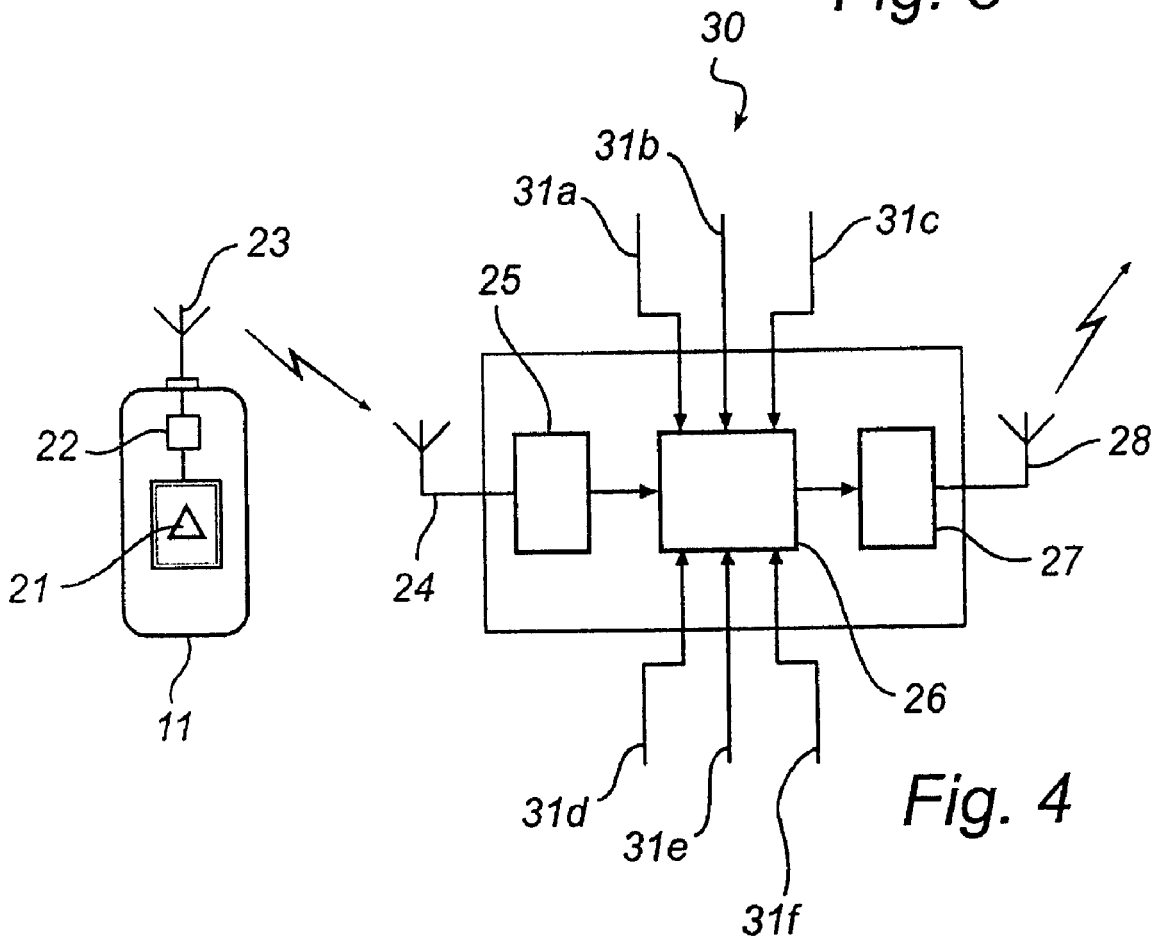
FIG. 4 illustrates schematically a second embodiment of the emergency call system according to an example embodiment.

FIG. 4 shows schematically an example embodiment of an emergency call system. The emergency call system 30 may differ from emergency call system 19 by the control unit 26 being adapted to obtain safety-related signals 31*a-f* from sensors located in the car.

Figure 5:
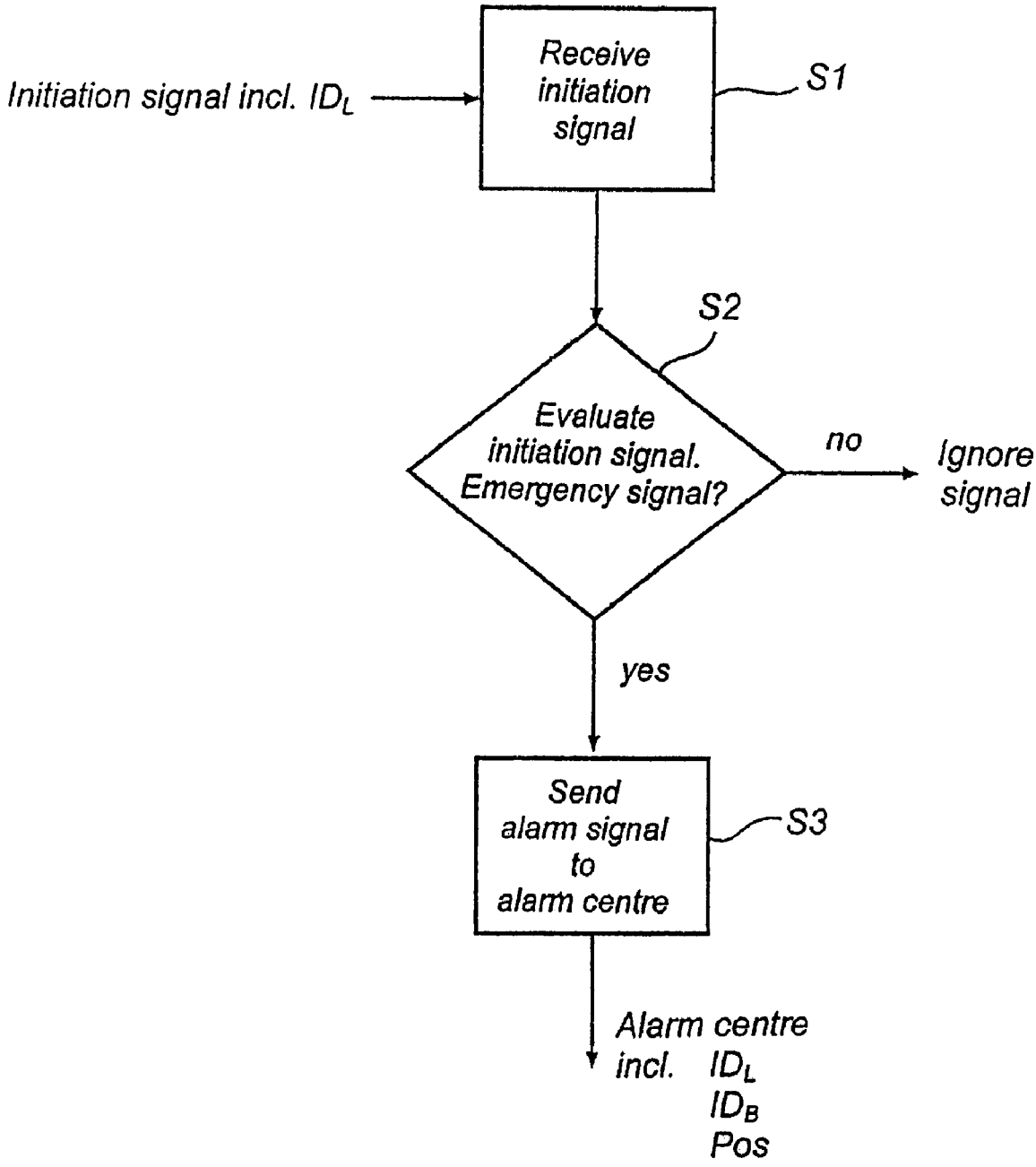
FIG. 5 is a flow chart which schematically illustrates a first embodiment of a method according to an example embodiment.

FIG. 5 illustrates schematically an example embodiment of a method, according to which at S1 an initiation signal together with an identification code IDL belonging to an alarm unit is received. At S2, the initiation signal is evaluated to establish whether the signal is an emergency signal or only some other type of signal at the frequency band in question (for instance a signal to unlock a car). If the initiation signal is assessed to be a valid emergency signal, S3, sending an alarm signal to an alarm centre is performed. Otherwise, the signal is ignored. Included in the alarm signal, preferably the identification code IDL of the alarm unit, the identification code IDB of the car and also the position of the car are transmitted. If the car is equipped with a GPS navigation system, the exact position of the car can be transmitted. If the car has no GPS system, information about the GSM cell in question or the like can be sent instead.

Figure 6:
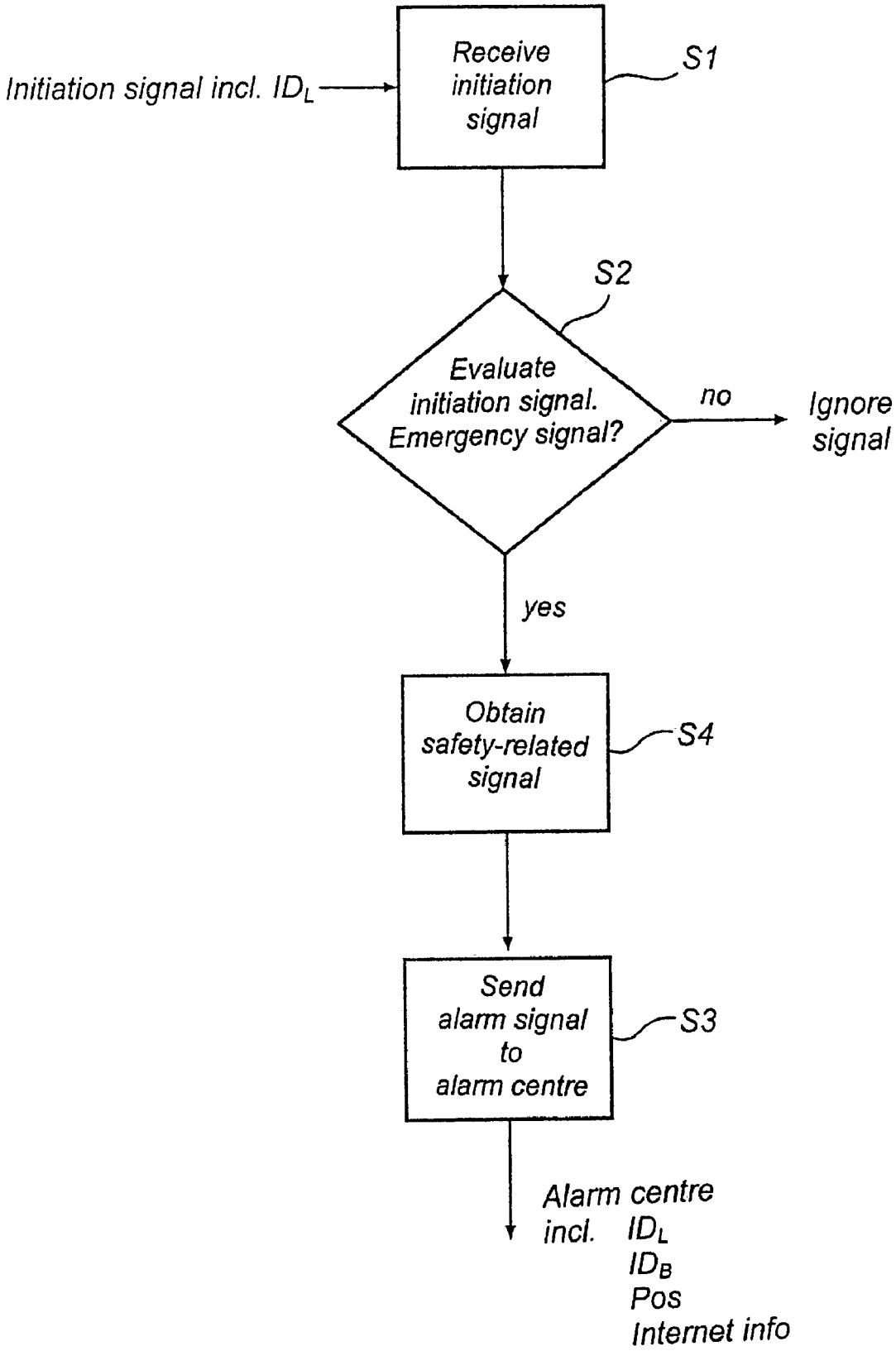
FIG. 6 is a flow chart which schematically illustrates a second embodiment of the method according to an example embodiment.

FIG. 6 illustrates schematically an example embodiment of a method, which differs from the example embodiment described above by S4, which obtains at least one safety-related signal being added. Safety-related signals can be, for instance, at least one of belt stretching signal, acceleration sensor signal, temperature signal, airbag signal, tyre pressure signal and engine status signal. Of course, also other signals are conceivable. Additional information about the emergency can be sent to the alarm centre by way of one or more of these signals.

A person skilled in the art realises that a number of additional variants and modifications of example embodiments described are possible within the scope of the appended claims. For example, the alarm unit, of course, need not be connected to a specific vehicle, but can be associated with an individual and adapted to send an initiation signal that is perceived as an emergency signal by the emergency call system.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of example embodiments, and all such modifications as would be obvious to one skilled in the art are intended to be included within the scope of the following claims.

The invention claimed is:

1. A method for an emergency call from a vehicle to an alarm center, comprising:

receiving a wireless initiation signal from a portable alarm unit, said wireless initiation signal including an identification code which identifies the alarm unit;

evaluating said initiation signal; and sending, based on the result of said evaluation, a wireless alarm signal from a vehicle communication system arranged in the vehicle to the alarm center, wherein evaluating said initiation signal includes:

identifying said initiation signal as an emergency signal;

allowing emission of a wireless alarm signal in response to a wireless initiation signal from each of a plurality of portable alarm units, said alarm units having different identities; and at least one of said portable alarm units having no relation to said vehicle.

2. A method as claimed in claim 1, wherein emission of a wireless alarm signal is allowed in response to a wireless initiation signal from a portable alarm unit which is related to another vehicle.

3. A method as claimed in claim 1, further comprising obtaining a safety-related signal from a sensor located in the vehicle.

4. A method as claimed in claim 3, wherein said evaluating said initiation signal further comprises evaluating said safety-related signal in order to thus obtain information about an emergency.

5. A method as claimed in claim 1, wherein said alarm signal comprises information about at least one of the position of the vehicle, the identity of the vehicle, the identity of the alarm unit and the emergency.

6. An emergency call system for vehicles, comprising:

a receiver located in a vehicle and adapted to receive a wireless initiation signal from a portable alarm unit, a control unit connected to the receiver and adapted to send, after evaluation of said initiation signal, an alarm command to a vehicle communication system, the vehicle communication system being adapted to send, in response to said alarm command, a wireless alarm signal to an alarm center, said wireless initiation signal including an identification code which identifies the alarm unit, and said control unit being adapted to send an alarm command to said vehicle communication system in response to a wireless initiation signal from each of a plurality of portable alarm units with different identities, wherein at least one of said portable alarm units having no relation to said vehicle.

7. An emergency call system as claimed in claim 6, wherein said control unit is adapted to send an alarm command to said vehicle communication system in response to a wireless initiation signal from a portable alarm unit which is related to another vehicle.

8. An emergency call system as claimed in claim 6, wherein said control unit is further adapted to obtain a safety-related signal from a sensor located in the vehicle.

9. An emergency call system as claimed in claim 8, wherein said control unit is further adapted to evaluate said safety-related signal in order to thus obtain information about an emergency.

10. An emergency call system as claimed in claim 6, wherein said alarm signal comprises information about at least one of the position of the vehicle, the identity of the vehicle, the identity of the alarm unit and the emergency.

* * * * *